United States Patent [19]

Mutchler

[11] Patent Number: 4,767,314

[45] Date of Patent: Aug. 30, 1988

[54] PULSE JET ENGINE ASSEMBLY

[75] Inventor: Paul A. Mutchler, St. Louis County, Mo.

[73] Assignee: Engineered Air Systems, Inc., St. Louis, Mo.

[21] Appl. No.: 59,611

[22] Filed: Jun. 8, 1987

[51] Int. Cl.[4] ..... F23C 11/04

[52] U.S. Cl. ..... 431/1; 60/247; 60/39.8; 60/39.76

[58] Field of Search ..... 431/1; 60/39.76–39.81, 60/247–249

[56] References Cited

U.S. PATENT DOCUMENTS 3,279,179 10/1966 Kemenczky ..... 60/247

4,640,674 2/1987 Kitchen ..... 431/1

*Primary Examiner*—Carroll B. Dority, Jr.

*Attorney, Agent, or Firm*—Ralph B. Brick

[57] ABSTRACT

An improved arrangement for a pulse jet engine assembly wherein pulsations of the engine are utilized to operate a motive source for a fuel pump which pumps fuel from a fuel supply source to the engine, the entire pulse jet engine assembly being internally self-sufficient after initial starting operation.

14 Claims, 3 Drawing Sheets

PULSE JET ENGINE ASSEMBLY

BACKGROUND OF THE INVENTION

The present invention relates to engine assemblies and more particularly to a pulse jet engine assembly including a novel structure for feeding fuel to the combustion chamber of a pulse jet engine.

It has been well known in the art of pulse jet engines to control fuel to pulse jet combustion chambers through valving arrangements responsive to combustion pressure variations within the combustion chambers, such arrangements being disclosed in U.S. Pat. No. 2,838,102, issued to E. Reimers on June 10, 1958 and U.S. Pat. No. 2,939,278, issued to H. M. Fox on June 7, 1960. It also is generally known to pump fluids through a diaphragm pump driven by a prime mover such as an electric motor, attention being directed to U.S. Pat. No. 4,390,324, issued to R. Karliner on June 28, 1983. Further, it is known to deliver fuel to a burner nozzle at a pulsing frequency dynamically matched to intermittent pressure pulses of a rotatable shaft driven gear pump, attention being directed to U.S. Pat. No. 4,391,580, issued to D. L. Hunsberger et al. on July 5, 1983.

The present invention recognizes the desirability of providing a self-contained, internally powered engine assembly which is light in weight, which is efficient and durable in operation, which requires a minimum of space, which can be employed with various types of liquid fuels and which can be operative under high pressures and oscillation frequencies in both stationary and mobile environments. The present invention, recognizing such desired criteria for an engine assembly, provides a novel, compact, straightforward, economical and sturdy pulse jet engine assembly which achieves these desired criteria and which, after initial manual assistance, can remain durable and efficiently operative over extended periods of time, being capable of using various types of fuels which can be pumped with single or ganged pumps to the combustion chamber of the engine through the high frequency pulsing energy of the engine. In addition, the present invention provides an assembly which minimizes the use of previously required rings and sealing members, effectively utilizing the low pressure drops and high pulsing frequencies common to pulse jet engines.

Further, the present invention utilizes the variable combustion pressures of the engine for a motive source which can be liquid submergible to drive or pump engine fuel, also providing a novel heat exchanger arrangement for lowering pulsing combustion gas temperatures prior to utilization with the novel motive source for pumping fuel to the engine. Moreover, the present invention provides for the economical and efficient introduction of comparatively small and finely metered quantities of various types of fuel in a closely timed manner heretofore unknown in the art.

Various other features of the several parts of the inventive engine assembly will become obvious to one skilled in the art upon reading the disclosure set forth herein.

SUMMARY OF THE INVENTION

More particularly, the present invention provides a pulse jet engine assembly comprising: a combustion chamber having a fuel inlet for admitting a combustible fuel into the chamber; a combustible fuel supply reservoir; a fuel pump connected to the fuel supply reservoir and the combustion chamber fuel inlet; and motive means operatively responsive to combustion gas fluctuations or pulsations within the combustion chamber to drive the fuel pump to deliver a supply of fuel under pressure to the combustion chamber fuel inlet. In addition, the present invention provides an arrangement for continuous supply of fuel under pressure to the combustion chamber fuel inlet and a novel heat exchanger for reducing the temperature of combustion gases from the combustion chamber.

It is to be understood that various changes can be made by one skilled in the art in the several parts of the novel pulse jet engine assembly disclosed without departing from the scope or spirit of the present invention. For example, changes could be made in the connection between the motive means and the fuel pump and in the heat exchanger used to reduce combustion gas temperatures without departing from the inventive concept.

BRIEF DESCRIPTION OF THE DRAWINGS

Referring to the drawings which disclose an advantageous embodiment of the present invention with modifications to certain parts thereof.

DETAILED DESCRIPTION OF THE DRAWINGS

Figure 1:
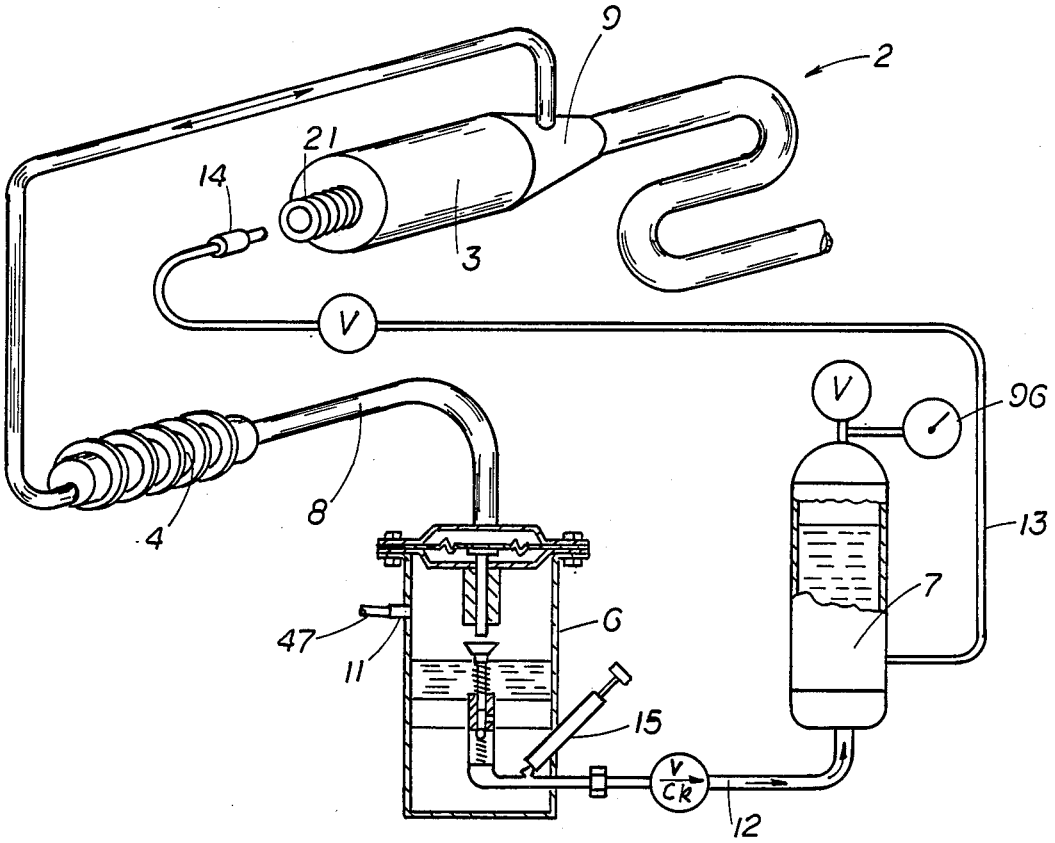
FIG. 1 is a schematic view of an advantageous form of the several parts of the novel pulse jet engine assembly with the fuel pump partially broken away.

Referring to FIG. 1 of the drawings, the novel pulse jet engine assembly 2 broadly includes a pulse jet combustion chamber 3, heat exchanger 4, fuel pump 6, and accumulator 7. Duct 8, which passes through heat exchanger 4, connects downstream transitional evase section 9 of combustion chamber 3 to one extremity of fuel pump 6. Fuel pump 6 is connected at an upper fill opening 11 to duct 47 which leads to a suitable fuel supply source (not shown). The other extremity of fuel pump 6 is connected by fuel supply duct 12 to accumulator 7. The accumulator 7, in turn, is connected by fuel supply duct 13 to fuel inlet nozzle 14 for combustion chamber 3. A suitable manual pump 15 associated with duct 12 is provided to initiate starting operations.

Figure 2:
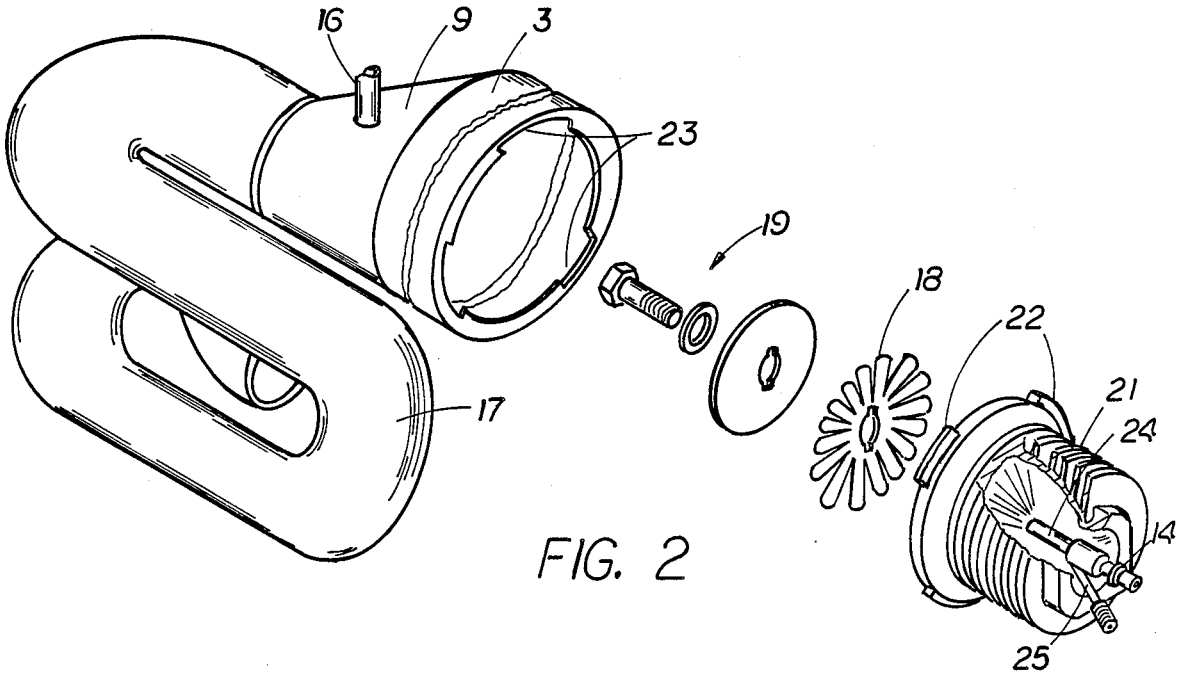
FIG. 2 is an enlarged exploded isometric view of the combustion chamber, engine head therefor, fuel injection and exhaust gas parts of the pulse jet engine assembly of FIG. 1, disclosing the fuel injection apparatus upstream of the petal valve for the combustion chamber and extending within the engine head for the chamber which is partially broken away.

Referring to FIG. 2 of the drawings, which more fully discloses the several parts of the combustion chamber assembly, it can be seen that the transition or evase section 9 of combustion chamber 3 is provided with an outlet 16 since combustion gases are the cleanest in this area. Outlet 16 is connected at one end to aforementioned duct 8 which passes through heat exchanger 4 and is connected to fuel pump 6, described more fully hereinafter. Physically, the combustion chamber 3, which can be formed from a suitable light metal alloy, can be quite compact, measuring approximately one (1) foot in length by approximately four (4) inches in diameter with the transition section 9 measuring approximately three (3) inches and tapering inwardly at its extremity to approximately two (2) inches in diameter. This tapered extremity is connected at one end to a tailpiece or exhaust manifold 17 which measures in length approximately eight (8) feet. For compactness and heat concentration, the tailpiece 17 is formed into three 180° U-bends so that, if desired, the pulse jet combustion chamber 3 can nest into a suitable cylindrical shell (not shown) of approximately one foot in diameter and two feet in length. The chamber defined by the shell can serve to accommodate appropriate heat exchanger tubes (also not shown) which can be used to serve an appropriate energy producing steam boiler (not shown). By way of example, heated chamber can be used for other purposes, such as an evaporator for fog oil for a smoke generating assembly (also not shown).

The combustion chamber 3 operates by exploding fuel therein at a very rapid rate, generally operating at a rate of sixty (60) cycles per second, thus firing 3600 times per minute or 216,000 times per hour with fuel consumption being about three (3) gallons per hour. This firing generates temperatures which reach as high as 2000° F. and which generally are in the range of 1300° to 1500° F. Thus, an appropriate heat exchanger 4 is required for cooling the gases from tailpiece or exhaust manifold 16 to a preselected temperature depending upon use.

To introduce fuel such as gasoline into combustion chamber 3, one end of chamber 3 is provided with a petal valve 18 which is mounted by bolt, washer and back-up plate assembly 19 to one end of engine head 21, the spaced peripheral lugs 22 nesting in slots 23 at the end of chamber 3 opposite tailpiece 17. Positioned upstream of petal valve 18 is fuel injector inlet 14 which is adapted to introduce fuel into chamber 3 through the flap valve acting extremities of petal valve 18 when the pressure in combustion chamber 3 is negative to open such extremities in a manner well know in the art during the exhaust portion of a firing cycle. It is to be noted that the vaporized fuel spray of injector inlet 14 and the combined entering air serve to cool the extremities of petal valve 18 when they are in closed position during the ignition portion of a firing cycle. As can be seen in FIG. 1, fuel injector inlet 14, which can include a flow injector 24 and a metering jet 25, is connected by duct 13 to fuel accumulator 7 so that a continuous flow of fuel under pressure can be delivered to combustion chamber. It is to be understood that an appropriate intermittently battery-magneto spark plug ignition system (not shown) can be employed with combustion chamber 3 to intermittently spark and ignite the vaporized fuel delivered into the chamber through petal valve 18. It is further to be understood that the pressure peak in combustion chamber 3 following the ignition portion of the firing cycle can reach approximately sixteen (16) psig but that it is of extremely short duration with the average pressure in the combustion chamber being approximately five (5) psig for approximately nine (9) milliseconds. The negative pressure in the combustion chamber 3 for the balance of the cycle is approximately two and one-half (2.5) psig below atmospheric pressure. Since the diaphragm and piston hardware of the fuel pump 6 (described more fully hereinafter) must be in phase with the aforedescribed pressure fluctuations of the combustion chamber 3 between the positive and negative pressures relative atmospheric pressure, the proper flexibility characteristics of the diaphragm are essential to pump operation.

It is to be understood that it is also possible to inject fuel downstream of petal valve 18 by modifying the fuel injector 24 to extend centrally through petal valve 18 to introduce fuel within combustion chamber 3 in spaced relation from the petal valve on the downstream side thereof (not shown). Such an arrangement can be more desirable when low vaporization fuels such as diesel oil are used, the residual heat of the combustion chamber 3 serving to volatilize the fuel for proper combustion.

Figure 3:
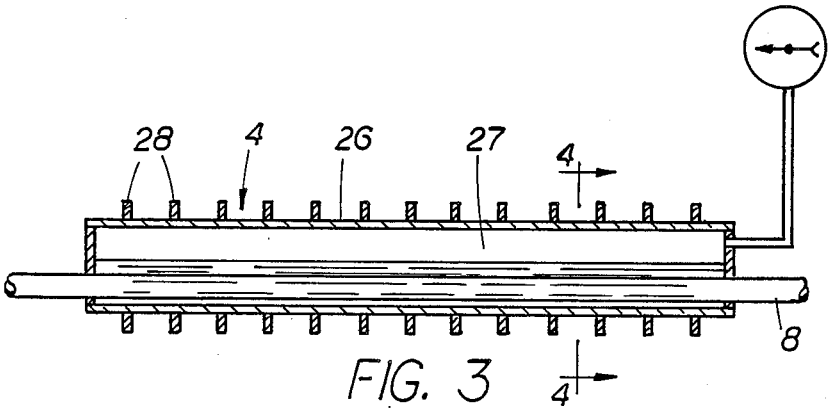
FIG. 3 is an enlarged, broken away, sectional view of one novel form of heat exchanger apparatus usable as one part of the assembly of FIG. 1.
Figure 4:
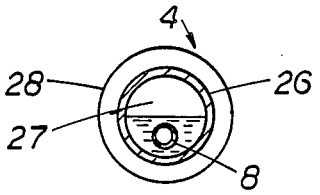
FIG. 4 is a cross-sectional view taken in a plane through line 4—4 of FIG. 3.

Referring to FIGS. 3 and 4, details of heat exchanger 4 which advantageously can be used to cool the hot combustion gases emanating from outlet 16 in transition 9 of combustion chamber 3, are disclosed. This heat exchanger device includes a longitudinally extending tube or duct 26 of greater internal diameter than the external diameter of duct 8 with the extremities of tube 26 being sealed to the external wall of tube 8 to provide a sealed chamber 27 surrounding tube 8. In this regard, it is to be noted that the external tube 26 and internal duct 8 are arranged to extend horizontally with the longitudinal axis of tube 26 being parallel to and offset or eccentrically mounted above the longitudinal axis of duct 8. A suitable liquid such as water or a suitable chemically treated liquid having a low boiling point and low freezing point can be introduced into surrounding sealed chamber 27 in an amount sufficient to have the liquid surface thereof cover duct 8 advantageously occupying twenty (20) to thirty (30) percent of the volume of chamber 27 with a vacuum drawn in the remaining void of chamber 27. To enhance heat exchange conductivity an appropriately spaced finned assembly 28 such as a plurality of spaced discs or a helically wound fin surrounds the outer surface of tube 26 in edge contacting relationship therewith. The vacuum drawn heat exchanger assembly permits the liquid therein to boil at low temperatures with the condensing vapors above the liquid removing the heat from the oscillation hot gases with combustion temperatures in the range of 1300° F. to 1500° F. passing through duct 8 to fuel pump 6 bringing the temperatures down to a range of approximately 150° F. to 200° F. before the oscillating gases are introduced into fuel pump 6.

Figure 5:
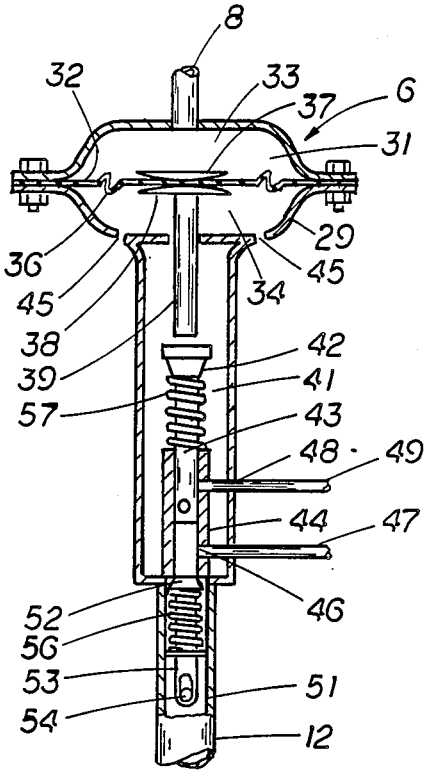
FIG. 5 is an enlarged cross-sectional view of a modified form of pulse diaphragm fuel pump which can be utilized in the pulse jet engine assembly of the present invention; and, FIG. 6 is an enlarged cross-sectional view of another modified form of pulse diaphragm fuel pump which can be utilized in the pulse jet engine of the present invention.

Referring to FIG. 5, the rudiments of one form of a typical diaphragm type pulsing fuel pump are disclosed. It is to be understood that any one of a number of known pulsing type pumps such as the one disclosed in aforementioned U.S. Pat. No. 4,390,324 can be adapted for use in the assembly so long as the pump is light, efficient and sensitive to the engine pulsations. Fuel pump 6 as disclosed includes a motive assembly operatively responsive to the combustion gas pressures. This motive assembly includes a plenum defining housing 29 defining plenum 31 which has a flexible diaphragm 32 extending thereacross to provide driving subchamber 33 on one side thereof sealed from driven subchamber 34 on the other side with duct 8 through which the oscillating gases pass from combustion chamber 3 being communicatively connected to driving subchamber 33.

It is important that diaphragm 32 be of sufficient strength and flexibility to withstand the pressures and respond to the fluctuations of the gases from duct 8. Advantageously, a diaphragm of fabric and elastomer material having a temperature lititation above that of the gas introduced into driving subchamber 33 can be used. To enhance flexibility such a diaphragm can be provided with a convolution 36 extending in a circular fashion therearound in spaced relation from the periphery which is sealed to housing 29. Opposed discs 37 and 38 are mounted on opposite faces of flexible diaphragm 32, the disc 38 in driven subchamber 34 having one end of reciprocable plunger 39 attached thereto. The other end of reciprocable plunger 39 which passes through plenum housing 29 into attached elongated chamber 41 is disposed to abuttingly engage head 42 of single stroke piston 43 slidably disposed in cylinder 44 mounted in elongated chamber 41. It is to be noted that driven subchamber 34 is provided with suitable vents 45 to vent subchamber 34 to atmosphere when diaphragm 32 is flexed. It further is to be noted that flexible diaphragm 32 could be formed from a suitable light, flexible, corrosive resistant metal such as stainless steel capable of withstanding high gas temperature so that it would be possible to connect duct 8 to plenum defining housing 29 without requiring heat exchanger 4.

To introduce fuel into cylinder 44, an aperture 46 is provided in the cylinder wall before the driving end of reciprocable piston 43, the aperture 46 being connected by a reservoir duct 47 to a suitable fuel supply source or reservoir (not shown). A second aperture 48 can be provided in the wall of cylinder 44 above aperture 46, this aperture 48 serving to accommodate any fuel leakage and being connected to a leakage duct 49 which can return to the fuel supply reservoir (not shown). The outlet end of cylinder 44 is provided with sleeve 51 connected to one end of aforedescribed fuel supply duct 12 (FIG. 1), the other end of duct 12 being connected to aforedescribed accumulator 7. A valve head 52 is disposed in sleeve 51 to yieldingly close the outlet end of cylinder 44. In this regard, valve head 52 is provided with a stem 53 slotted at the distal end to receive transverse pin 54 extending across and fixed to sleeve 51. A suitable helical spring 56 disposed in sleeve 51 above pin 54 serves to urge the valve head 52 to biased closed position. In like fashion, a suitable helical spring 57 surrounding piston 43 above the opposite end of cylinder 44 serves to bias piston head 42 to return position after it has been urged downwardly by plunger 39. In operation, fuel is introduced from supply duct 47 and when gas pressure in driving subchamber 33 urges plunger 39 downwardly, it abuts piston head 42 with single stroke piston 43 forcing the fuel to accumulator duct 12.

It is to be understood that two or more single piston-cylinder pumps can be operated from a common diaphragm and piped in parallel in gang fashion to increase flow volume at the same pressure of a single pump. It also is to be understood that the piston-cylinder can be submerged in a fuel container in a manner as is suggested in FIG. 1.

Figure 6:
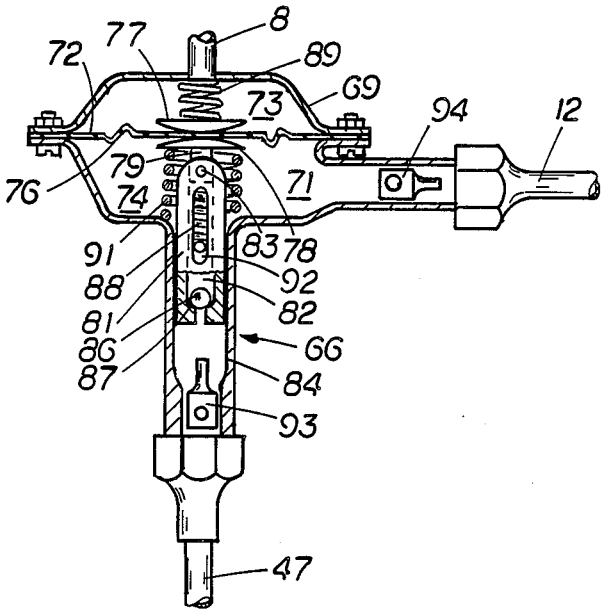

Referring to FIG. 6, the fundamentals of a modified form of diaphragm type pulsing fuel pump 66 are disclosed. As in previously described fuel pump 6, a motive assembly operatively responsive to combustion gas pressures is provided to include a plenum defining housing 69 defining plenum 71 which has a flexible diaphragm 72 extending thereacross to provide driving subchamber 73 on one side thereof sealed from driven subchamber 74 on the other side with duct 8 through which the oscillating gases pass from combustion chamber 3 being communicatively connected to driving subchamber 73. As before discussed for diaphragm 32, it is important that diaphragm 72 be of sufficient strength and flexibility to withstand the pressures and respond to the fluctuations of the gases from duct 8. Accordingly, diaphragm 72 which is sealed to housing 69 can be selected from the same materials and be substantially of the same design as diaphragm 32 including a convolution 76 similar to convolution 36 and, in a like manner, as discs 37 and 38 opposed discs 77 and 78 are mounted on opposite faces of flexible diaphragm 72 with disc 78 in driven chamber 74 having one end of reciprocable plunger 79 attached thereto. At this point the modified fuel pump 66 differs substantially from fuel pump 6. The other end of plunger 79 has one end of an elongated piston 81 connected thereto by pin 83. Piston 81 is hollowed to include an elongated chamber 82 closed at the suspended end of the piston and opened at the opposite end. Piston 81 slidably and snugly engages in elongated cylinder 84, which, in fact, is an extension of housing 69 adjacent driven subchamber 74. Hollow, elongated piston 81 is provided with a sphere valve 86 which can be of a suitable material such as Teflon. Sphere valve 86 is sized to slidably move in elongated chamber 82 of piston 81, the elongated chamber 82 within piston 81 internally necking adjacent the open end of chamber 82 opposite the pin suspended end to provide a valve seat 87 for sphere valve 86. A coiled spring 88 is provided within chamber 82 to bias sphere valve 86 to closed position and coiled springs 89 and 91 are provided in subchambers 73 and 74 respectively to bias the flexible diaphragm 72 on either side thereof. It is to be noted that elongated piston 81 is provided with an elongated slot 92 therein sized in width to retain sphere valve 86 in hollow chamber 82 and of sufficient length to project into subchamber 74 during a portion of the piston stroke in cylinder 84.

It is further to be noted that the open end of elongated cylinder is communicatively connected to aforedescribed reservoir duct 47 leading to a fuel supply source of reservoir (not shown) and that driven subchamber 74 is communicatively connected to aforedescribed accumulator supply duct 12. Suitable check valves 93 and 94 which can be in the form of duck bill valves are provided at the openings of elongated chamber 82 and subchamber 74 respectively. This modified fuel pump 66 depends on the negative pressure fluctuation to initiate fuel flow as distinguished from aforedescribed fuel pump 6. When the pressure is negative in subchamber 73, a similar condition occurs in subchamber 74 and fuel is introduced from line 47 through check valve 93, urging spring biased sphere valve 86 to open position with fuel flowing through slot 92 into subchamber 74 and out accumulator duct 12, the subsequent positive pressure further urging fuel in chamber 74 through duct 12. Check valves 93 and 94 serve to prevent fuel backflow.

As can be seen in FIG. 1, whether fuel pump 6 or modified pump 66 is connected in the fuel supply system, duct 12 is connected to accumulator 7, this accumulator 7 with a suitable pressure gauge 96 mounted thereon, serving to insure a constant fuel supply through duct 13 to fuel nozzle inlet 14 for combustion chamber 3.

From the aforedescribed, it can be seen that a novel self-contained, internally powered pulse jet engine assembly is provided which is compact, light in weight, efficient and durable in operation, requiring a minimum of parts and repair and which can be operated in both stationary and mobile environments with various types of fuels.

The invention claimed is:

1. A pulse jet engine assembly comprising: a combustion chamber having a fuel inlet for admitting a combustible fuel into said chamber;

a combustible fuel supply reservoir;

a fuel connected to said fuel supply reservoir and said combustion chamber fuel inlet; and motive means operatively responsive to combustion gas pressure fluctuations within said combustion chamber to drive said fuel pump to deliver a supply of fuel under pressure to said combustion chamber fuel inlet, said motive means including an enclosed chamber having a flexible diaphragm extending thereacross to provide driving and driven subchambers with said driving subchamber connected to said combustion chamber and said driven subchamber connected to said fuel pump to operate said fuel pump.

2. The engine assembly of claim 1, said fuel pump including a piston cylinder and reciprocable piston disposed therein and connected to said driven subchamber being cooperativley adapted to deliver fuel under pressure during a fuel pumping stroke from said fuel supply reservoir to said combustion chamber inlet.

3. The engine assembly of claim 1, and an accumulator reservoir positioned between said fuel pump and said combustion chamber to provide for continuous delivery of fuel under preselected pressure to said combustion chamber fuel inlet.

4. The engine assembly of claim 1, and a heat exchanger positioned between said combustion chamber and said motive means operatively responsive to combustion gas pressure fluctions to control the temperature of the combustion gases.

5. The engine assembly of claim 1, said fuel pump including a piston cylinder and reciprocable piston disposed therein cooperatively adapted to deliver fuel under pressure during a fuel pumping stroke from said fuel supply reservoir to said combustion Chamber inlet and piston biasing means to return said piston to its intial position upon completion of a fuel pumping stroke.

6. The engine assembly of claim 1, and a heat exchanger positioned between said combustion chamber and said motive means operatively responsive to combustion gas pressure fluctuations to control the temperature of the combustion gases, said heat exchanger including a preselected portion of a longitudinally extending combustion gas flow-through conduit which connects said combustion chamber with said motive means and a longitudinally extending outer finned housing jacket spaced from and surrounding said preselected portion of said flow-through conduit with the extremities of said housing jacket being sealed to said flow-through conduit to define an enclosed plenum surrounding said preselected portion of said flow-through conduit, said enclosed plenum having a cooling liquid disposed therein in an amount sufficient to cover said jacketed flow-through portion of said conduit with the remaining void portion of said enclosed plenum being under a vacuum to allow the cover liquid to boil at low temperatures extracting and passing heat to ambient from combustion gases passing through the preselected portion of the longitudinally extending flow-through conduit.

7. The engine assembly of claim 1, said combustion chamber having a flexible petal valve upstream of said chamber with the falp valve extremities thereof opened intermittently by negative pressure within said chamber to allow intermittent introduction of air and fuel into said chamber for combustion and a fuel atomizing means upstream of said flexible petal valve to provide for cooling of said flap valve petal extremities by the fuel when in closed position prior to introduction into said combustion chamber through said flap valve extremities of said flexible petal valve when said extremities are in opened position.

8. The engine assembly of claim 1, said combustion chamber having a flexible petal valve upstream of said chamber with the flap valve extremities thereof opened intermittently by negative pressure within said chamber to allow intermittent introduction of air into said chamber to support fuel combustion and a fuel atomizing means within said combustion chamber downstream of said flexible petal valve to mix the fuel with the air introduced into said chamber.

9. The engine assembly of claim 1, said fuel pump including a piston cylinder and reciprocable piston disposed therein cooperatively adapted to deliver fuel under pressure during a fuel pumping stroke from said fuel supply reservoir to said combustion chamber inlet.

10. The apparatus of claim 9, said motive means and said fuel pump being operatively responsive to positive combustion gas pressure fluctuations.

11. The apparatus of claim 9, said motive means and said fuel pump being operatively responsive to negative combustion gas pressure fluctuations.

12. The engine assembly of claim 1, wherein said flexible diaphragm is stainless steel.

13. The engine assembly of claim 1, wherein said flexible diaphragm is a fabric and elastomer.

14. A pulse jet engine assembly comprising: a combustion chamber having a flexible petal valve upstream of said chamber with the flap valve extremities thereof opened intermittently by negative pressure within said chamber to allow intermittent introduction of air and fuel into said chamber for combustion;

a fuel atomizing means for said combustion chamber upstream of said flexible petal valve to provide for cooling of said flexible petal extremities by the fuel when in closed position prior to the introduction of the fuel into said combustion chamber through said flexible petal valves when said extremities are in opened position;

a combustible fuel supply reservoir;

a fuel pump connected to said fuel supply reservoir, said fuel pump including a piston cylinder and a reciprocable spring-biased piston disposed therein cooperatively adapted to deliver fuel under pressure from said reservoir during a fuel pumping stroke;

an accumulator connected to said fuel pump and said fuel atomizing means for said combustion chamber to provide for continuous delivery of fuel under preselected pressure to said fuel atomizing means;

motive means operatively responsive to combustion gas pressure fluctuations including an enclosed chamber having a flexible fabric and elastomer diaphragm extending thereacross with a convolution therein to provide driving and driven subchambers with said driving subchamber connected to the exhaust of said combustion chamber and said driven subchamber connected to said fuel pump spring-biased piston to move said piston to pump fuel from said supply reservoir to said accumulator; and, a heat exchanger positioned between said combustion chamber and said driving subchamber of said motive means to control the temperature of the exhaust combustion gases which contact said flexible fabric and elastomer diaphragm on said driving subchamber side of said enclosed chamber of said motive means.

* * * * *

UNITED STATES PATENT AND TRADEMARK OFFICE

CERTIFICATE OF CORRECTION

PATENT NO. : 4767314

DATED : 8/30/88

INVENTOR(S) : Paul A. Mutchler

It is certified that error appears in the above—identified patent and that said Letters Patent is hereby corrected as shown below:

Column 7, line 13, after "fuel" insert ---- pump ----;

Column 8, lines 30 and 33, each appearance, correct "9" to --- 1 ---.

Signed and Sealed this

Twenty-fourth Day of January, 1989

*Attest:*

DONALD J. QUIGG

*Attesting Officer*

*Commissioner of Patents and Trademarks*